United States Patent [19]

Griffin

[11] Patent Number: 4,731,897

[45] Date of Patent: Mar. 22, 1988

[54] MODULAR MOP HOLDER

[75] Inventor: Dana K. Griffin, Van Wert, Ohio

[73] Assignee: Tu-Way Products Company, Troy, Mich.

[21] Appl. No.: 32,871

[22] Filed: Mar. 31, 1987

[51] Int. Cl.[4] ..... A47L 13/254

[52] U.S. Cl. ..... 15/147 R; 15/228

[58] Field of Search ..... 15/228, 229 AP, 229 BP, 15/147 R, 147 A, 147 B, 147 C, 147 D

[56] References Cited

U.S. PATENT DOCUMENTS

| | | | |
|---|---|---|---|
| 1,381,879 | 6/1921 | Juska | 15/228 |
| 4,070,726 | 1/1978 | Joffre | 15/228 X |
| 4,184,224 | 1/1980 | Joffre | 15/228 |

*Primary Examiner*—Chris K. Moore

*Attorney, Agent, or Firm*—Robert G. Mentag

[57] ABSTRACT

A modular mop holder for flat mops including a basic section adapted to be attached to a mop handle, and wherein the basic sections length can be selectively increased by releasably connected extension sections.

8 Claims, 13 Drawing Figures

MODULAR MOP HOLDER

BACKGROUND OF THE INVENTION

1. Technical Field

The field of art to which this invention pertains may be generally located in the class of devices relating to mops. Class 15 , Subclass 147R, Mop Holders, United States Patent Office classifications, appears to be the applicable general area of art to which the subject matter similar to this invention has been classified in the past.

2. Background Information

It is known in the flat mopping art to provide different length mop holders which are pre-sized to hold different widths of mopping material, such as wet mopping material, dust mop material, and the like. Some users of mops desire for example an eighteen inch long mop holder while others desire longer mop holders. Because of the desire of users to employ mops of various widths, the distributors of mops must maintain an inventory of various sizes or lengths of mop holders. This situation creates an inventory problem which involves the investment of large funds to maintain a stock of various size mop holders.

The problem solved by the present invention is the elimination of the need for a plurality of pre-sized mop holders by the provision of a mop holder which can be extended lengthwise to provide any desired length mop holder, within the range of mop holders available and on the present market. The present invention provides a modular mop holder which is made to an initial length, but which can be quickly and easily extended lengthwise by adding on modular parts. The modular mop holder of the present invention eliminates the need for maintaining an expensive inventory of a plurality of different length mop holders. The distributors of mops now have available forty foot rolls of pre-treated dust mop material, launderable mop material, and hospital mop material, which eliminates the need for stocking various sizes of mop material. With the rolled mop material the distributors merely cut off the material to the proper size, and by providing a modular mop holder of the present invention, which may be extended and enlarged end-wise, the distributors of mops can further reduce the amount of mop holders which they must stock. The modular mop holder of the present invention thus permits distributors to not only reduce the amount of money invested in mop holder stock, but the present invention also eliminates the need for a large storage space for the different sized mop holders.

SUMMARY OF THE INVENTION

The present invention provides a modular mop holder which can be selectively increased in length to hold flat mops of any desired practical length. The modular mop holder includes an elongated mop holder basic section which is provided on each end thereof with connection means for releasably attaching to each end of the basic section additional add-on extension sections for increasing the length of the mop holder. The basic section is provided with means for attaching the mop holder to a mop handle. The ends of the mop holder basic section may be enclosed by an end section which has on its inner side a mating connection means and which is enclosed on its outer side. The modular mop holder may be increased in length by releasably attaching at least one or more extension sections to each end of the basic section and then mounting an end section on the outermost one of the extension sections. The connection means on each end of the mop holder basic section comprises a first type, shaped connection means. The first type, shaped connection means on one end of the basic section is a mirror image of the first type, shaped connection means on the other end thereof. The connection means on the inner side of each end section comprises a second type, shaped connection means which is complementary with the first type, shaped connection means. The extension sections are each provided on one end thereof with a connection means of the first type, shaped connection means and on the other end thereof with a connection means of the second type, shaped connection means.

The modular mop holder of the present invention provides a stable mop holder for flat mopping which can be quickly and easily extended in length to carry flat mops, either wet or dry, of various lengths. The connection means employed for releasably connecting the extension sections and end sections to the mop holder basic section hold the first mentioned sections to the basic section in an immovable relationship to provide a stable mop holder.

DESCRIPTION OF THE PREFERRED EMBODIMENT

Figure 1:
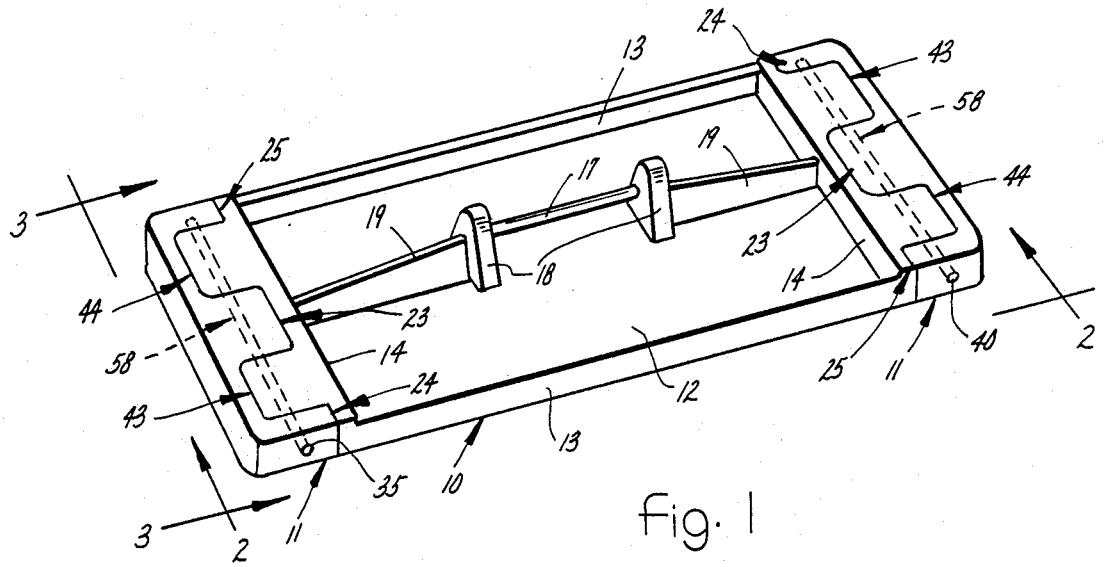
FIG. 1 is a top perspective view of a modular mop holder, made in accordance with the principles of the present invention.

Referring now to the drawings, and in particular to FIG. 1, the numeral 10 generally designates the basic section of the modular mop holder of the present invention. The basic section 10 may also be termed the center section. The numeral 11 generally designates each one of a pair of end sections which are detachably mounted on the ends of the basic section 10, for enclosing and slightly extending the length of the mop holder basic section 10 a small amount as for example a ¼ inch, and also to provide a smooth end surface on each end of the basic section 10. However, it will be understood that the basic section 10 could be used by itself as a mop holder for a predetermined width of mop, depending on the length of the basic section 10.

Figure 4:
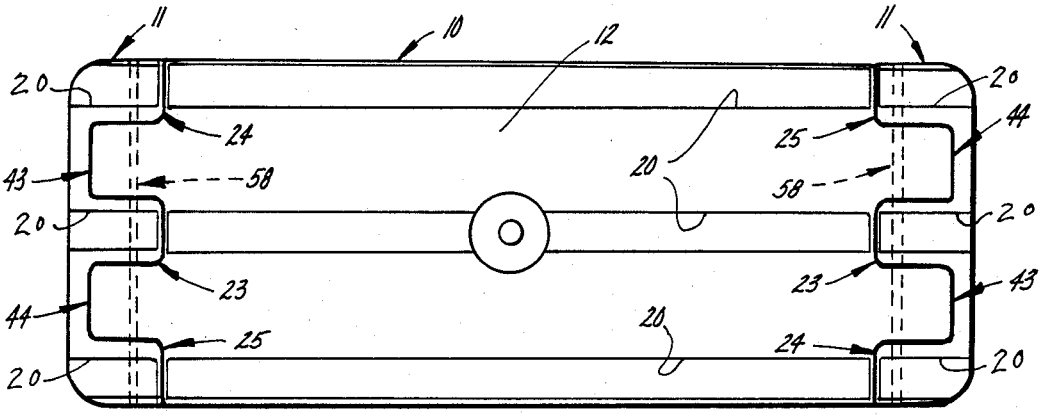
FIG. 4 is a bottom plan view of the modular mop holder illustrated in FIG. 2, taken along the line 4—4 thereof, and looking in the direction of the arrows.

As shown in FIGS. 1 and 4, the basic section 10 of the modular mop holder is substantially rectangular in overall plan form, and it is provided with a bottom wall 12 and a pair of integral side walls 13. The side walls 13 form a recess on the upper side of the bottom wall 12 which is bounded by a pair of end walls 14.

Figure 2:
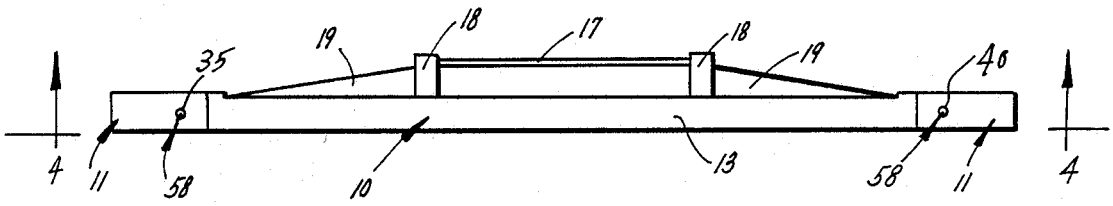
FIG. 2 is a front side elevation view of the modular mop holder illustrated in FIG. 1, taken along the line 2—2 thereof, and looking in the direction of the arrows.
Figure 3:
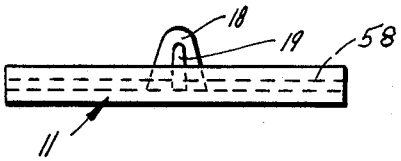
FIG. 3 is a left end elevation view of the modular mop holder illustrated in FIG. 1, taken along the line 3—3 thereof, and looking in the direction of the arrows.

As best seen in FIGS. 1 and 2, the basic section 10 of the modular mop holder is provided with a longitudinally and centrally disposed mop handle attachment bar 17 for attaching the mop holder to a conventional mop handle. The attachment bar 17 is mounted in a position parallel to the bottom wall 12, and in an upwardly spaced apart position. The ends of the attachment bar 17 are fixedly secured in a pair of support posts 18 which extend upwardly from the bottom wall 12. The basic section 10 of the mop holder is provided with a pair of centrally and longitudinally disposed, integral strength ribs 19 which extend between the outer sides of the posts 18 and the end walls 14. The last described posts 18 and strength ribs 19 are integrally formed with the aforedescribed other portions of the basic section 10, and the attachment bar 17 is preferably a metal bar. The basic section 10 and the end sections 11 may be made from any suitable material, as for example they may be molded from a suitable plastic.

As shown in FIG. 4, the basic section 10 of the mop holder and the end sections 11 are provided with a plurality of laterally spaced apart, longitudinal grooves 20, on the bottoms thereof, which are adapted to have seated therein and adhered thereto, strips of attachment material such as "VELCRO" or other suitable attachment material, for attaching mop material to the bottom surface of the modular mop holder. It will be understood that the modular mop holder of the present invention may also be used for other types of mops, as for example, a mop which may have an attachment sleeve on the top side thereof, into which the modular mop holder would be inserted.

Figure 5:
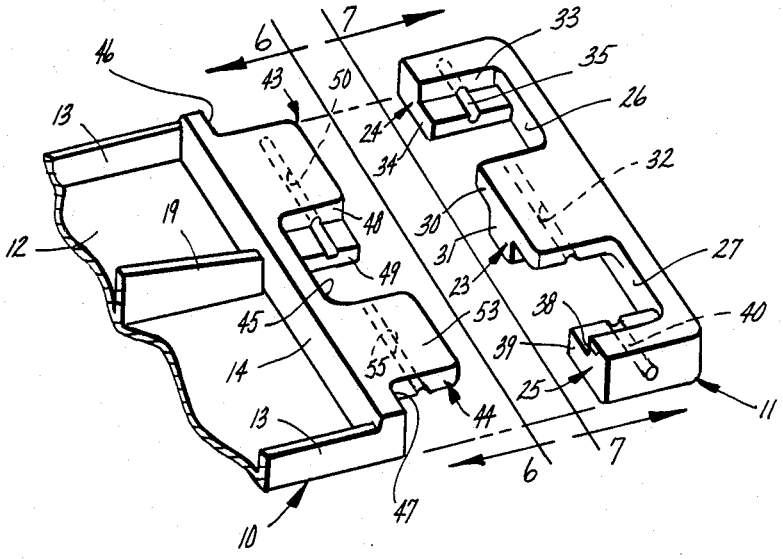
FIG. 5 is a fragmentary, top perspective view of one end of a modular mop holder, made in accordance with the principles of the present invention and showing one of the end sections separated from one end of the center or basic section of the mop holder.
Figure 7:
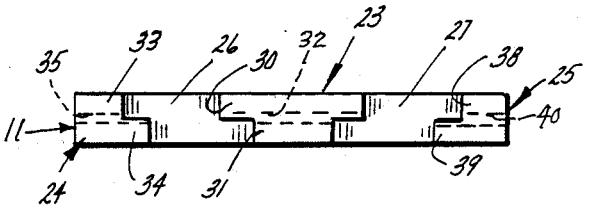
FIG. 7 is a left or inner side elevation view of the end section illustrated in FIG. 5, taken along the line 7—7 thereof, and looking in the direction of the arrows.

As shown in FIGS. 1 and 5, the basic section 10 of the modular mop holder is provided on each of its ends with what may be termed a first type, shaped connection means for complementary engagement with what may be termed a second type, shaped connection means on each of the end sections 11. The first type, shaped connection means on one end of the basic section 10 is a mirror image of the first type, shaped connection means on the other end thereof. As shown in FIGS. 5 and 7, a second type, shaped connection means is formed on the end section 11, and it includes a central, T-shaped male connection member, generally indicated by the numeral 23, and a pair of transversely spaced apart side outer male connection members 24 and 25. As viewed along line 7—7, of FIG. 5 the connection member 24 is substantially L-shaped in cross section and the connection member 25 is substantially reversed L-shaped in cross section.

As best seen in FIG. 7, the male connection member 23 is T-shaped in cross section and includes an upper horizontal portion 30 and a lower and narrower horizontal portion 31 which coacts with the integral upper portion 30 to form the T-shaped connection member 23. A transverse roll pin hole 32 is formed through the T-shaped connection member 23.

As viewed along the line 7—7 in FIG. 5, and as shown in FIG. 7, the male connection member 24 is substantially L-shaped in cross section and includes a vertical leg portion 33 and an integral horizontal foot portion 34. A roll pin hole 35 is formed transversely therethrough in alignment with the roll pin hole 32 in the male T-shaped connection member 23.

As shown in FIG. 7, the male connection member 25 is reverse L-shaped in cross section and includes a vertical leg portion 38 and an integral horizontal foot portion 39. The male connection member 25 is provided with a transverse roll pin hole 40 which is formed therethrough and is positioned in alignment with the roll pin holes 32 and 35 in the connection members 23 and 24.

As shown in FIGS. 5 and 7, a Z-shaped female recess 26 is formed between the male connection members 23 and 24. A reverse Z-shaped female recess 27 is formed between the male connection members 23 and 25.

Figure 6:
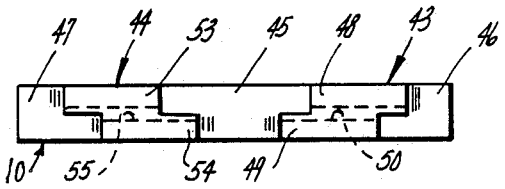
FIG. 6 is an elevation view of the right end of the center or basic section illustrated partially in FIG. 5, taken along the line 6—6 thereof, and looking in the direction of the arrows.

As viewed in FIG. 5, along the line 6—6, and as shown in FIG. 6, the first type, shaped connection means on each end of the basic section 10 includes a pair of male connection members 43 and 44, which are spaced apart by a T-shaped recess 45, and which are each bounded on the outer sides thereof by a reverse L-shaped reces 46 and a L-shaped recess 47, respectively. As shown in FIG. 6, the reverse Z-shaped male connection member 43 includes an upper horizontal portion 48 and a lower integral, horizontal, laterally offset, inwardly extended portion 49. The reverse Z-shaped male connection member 43 is provided with a transverse roll pin hole 50. The Z-shaped male connection member 44 includes an upper, horizontal portion 53 and an integral, lower and offset inwardly, horizontal foot portion 54. The Z-shaped male connection 44 is provided with a transverse roll pin hole 55 which is axially aligned with the roll pin hole 50 in the male connection member 43.

In assembling the end sections 11 onto their respective ends of the basic section 10 they are moved towared the basic section 10 and slid into position thereon, with the various aforedescribed male connection members meshing with each other and seating in the aforedescribed female recesses. When the end sections 11 are slid into the positions shown in FIGS. 1 and 4, the roll pins 58 are moved into the aforementioned roll pin holes through the various male connection parts to hold the end sections 11 against endwise movement relative to the basic section 10. It will be understood that the various overlapping portions of the male connection members are seated against each other in the assembled position shown in FIGS. 1 and 5, so that the end sections 11 are securely held onto the basic section 10 against movement in the sidewise directions, and in the upward and downward directions, and against an inward endwise direction. The roll pins 58 prevent the end sections 11 from sliding outwardly, in a lengthwise or endwise direction from the basic section 10.

Figure 9:
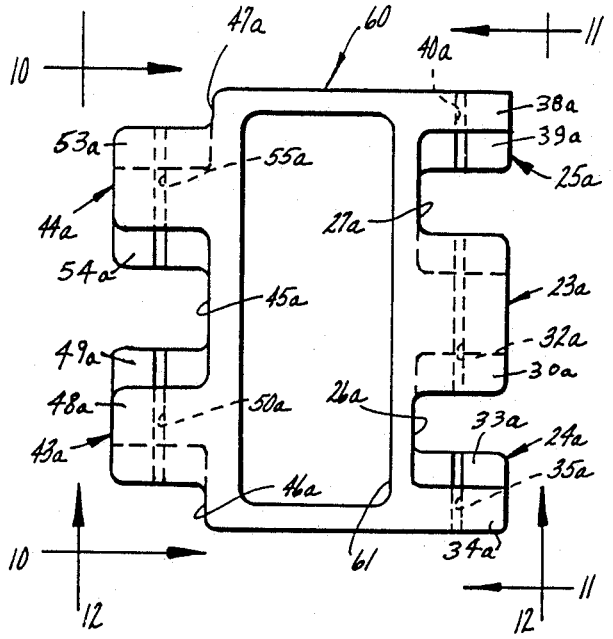
FIG. 9 is a top plan view of a modular extension section employed in the invention.
Figure 13:
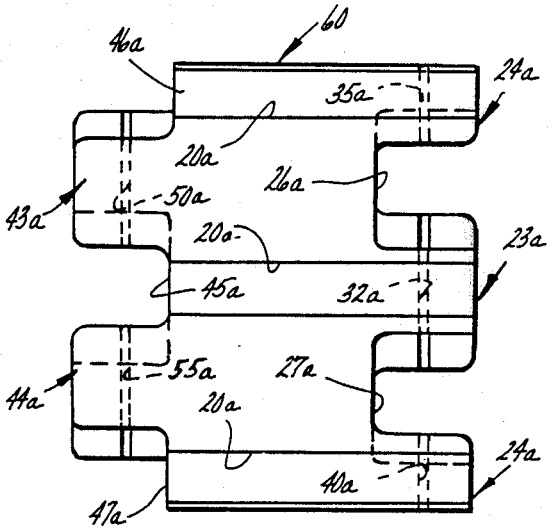
FIG. 13 is a bottom plan view of the modular extension section illustrated in FIG. 12, taken along the line 13—13 thereof, and looking in the direction of the arrows.
Figure 10:
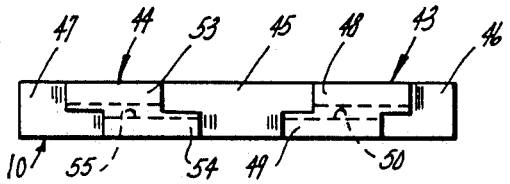
FIG. 10 is a left end elevation view of the modular extension section illustrated in FIG. 9, taken along the line 10—10 thereof, looking in the direction of the arrows, and showing the same connection structure as FIG. 6.
Figure 11:
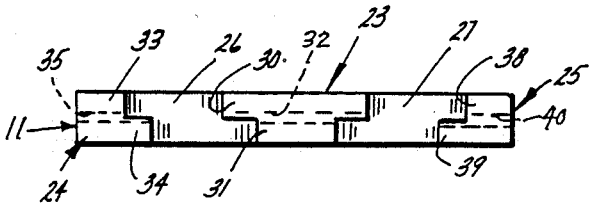
FIG. 11 is a right end elevation view of the modular extension section illustrated in FIG. 9, taken along the line 11—11 thereof, looking in the direction of the arrows, and showing the same connection structure as FIG. 7.
Figure 12:
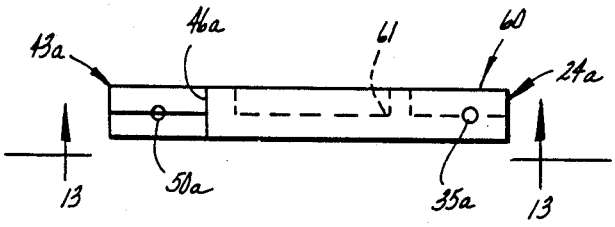
FIG. 12 is a front elevation view of the modular extension section illustrated in FIG. 9, taken along the line 12—12 thereof, and looking in the direction of the arrows.

As shown in FIGS. 9 and 13, each of the add-on or extension sections 60 is provided with a transverse recess 61 on the top side thereof. The add-on or extension sections 60 are identically formed and they can be mounted on either end of the basic section 10. As shown in FIGS. 9 and 13, each of the extension sections 60 has formed on one side thereof, a first type, shaped connection means comprising connection members which are the same as the first type, shaped connection members on the ends of the basic section 10. Accordingly, the last mentioned connection members on the extension section shown in FIGS. 9 and 13 have been marked with the same reference numerals as used on the basic section 10, followed by the small letter "a". The other end of each of the extension sections 60 are provided with a second type, shaped connection means which includes connection members identical to the second type, shaped connection means formed on each of the end members 11, and the same reference numerals have been used on said other end of the extension section 60, followed by the small letter "a". Because the shapes of the first and second type, shaped connection means employed on the basic section 10, the end section 11, and the extension section 60 are the same, it will be seen that the FIGS. 6 and 10 both represent the same type of connection means, namely, the first type, shaped connection means, and FIGS. 7 and 11 represent the second type, shaped connection means. However, the reference numerals on the last two mentioned FIGS. 6 and 10, and 7 and 11, have been marked only with the reference numerals employed in FIG. 5.

The extension sections 60 are made from the same material as employed in the making of the basic section 10 and the end sections 11, that is, any suitable material, such as a suitable plastic.

Figure 8:
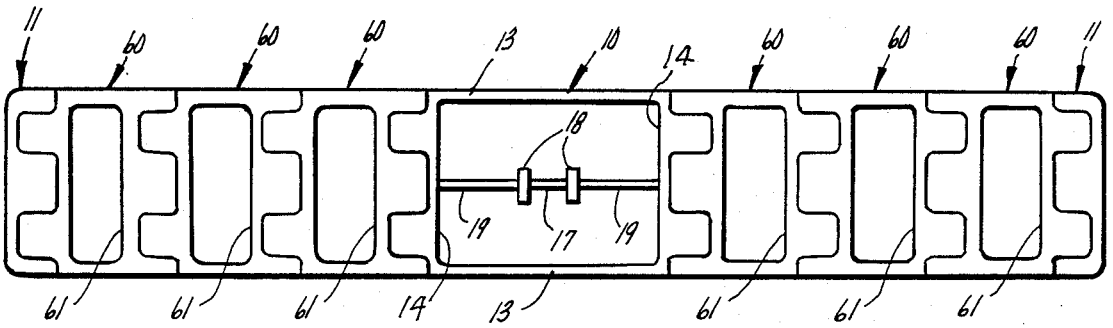
FIG. 8 is a top plan view of an extended modular mop holder, which was made longer than the mop holder of FIG. 1 by the insertion of a plurality of modular add-on or extension sections.

It will be understood that the basic section 10, the end sections 11, and the extension sections 60 may each be made to any desired length. In one embodiment the basic section 10 together with a pair of end sections 11 comprised a mop holder which was twelve inches in length. The extension sections 60 were each made to a length of three inches. In accordance with said one embodiment dimensions, the last mentioned dimensions for each of the sections in the mop holder illustrated in FIG. 8 would provide a mop holder having an overall length of thirty inches. It will also be understood that a shorter length mop holder could be made by eliminating tthe extension sections and the end sections 11.

It will be understood that the basic section 10 could be used by itself as a mop holder, with or without the two end sections 11. It will also be understood that the basic section 10 may be used with one or more of the extension sections 60, together with or without the end sections 11.

It will also be understood that although the term mop holder has been employed hereinbefore throughout this specification that the terms head or frame could also be used and they are synonymous with the term holder. It will also be understood that other configurations may be employed for the complementary first and second type, shaped connection members illustrated in the drawings and described in the specification of this application.

The complementary connection means employed in the invention provides a stable, modular mop holder wherein modular extension sections are held immovable relative to each other and provide an even mop surface for flat mopping purposes. The modular mop holder of the present invention can be easily and quickly extended from a basic section length of 12 inches to any desired length, as for example 24 inches, 36 inches, 48 inches, 72 inches, and so forth. The modular mop holder of the present invention eliminates the need to buy a plurality of unitary mop holders of different usable lengths.

What is claimed is:

1. A mop holder, adapted to be attached to a mop handle, comprising:

(a) an elongated mop holder basic section provided with means for attaching the mop holder to a mop handle, and adapted to have a mop element attached thereto; and, (b) said mop holder basic section being provided with a connection means on at least one of the lengthwise ends thereof, for selective connection to a connection means on at least one add-on mop holder section.

2. A mop holder as defined in claim 1, wherein:

(a) said mop holder basic section is provided with a connection means on each lengthwise end thereof, for selective connection at each end thereof, to a connection means on an add-on mop holder section.

3. A mop holder as defined in claim 2, wherein:

(a) the connection means on each lengthwise end of the mop holder basic section comprises a first type, shaped connection means;

(b) at least one add-on mop holder section having a second type, shaped connection means on one end thereof, is connected to each end of the mop holder basic section, with the first and second type, shaped connection means being complementary to each other and engaging each other, to hold the add-on sections on the basic section against relative movement therebetween, in upward, downward and sidewise directions, and against an inward lengthwise direction; and, (c) each of the add-on sections is retained on the basic section, against outward lengthwise movement relative to the basic section, by a releasable retainer means.

4. A mop holder as defined in claim 3, wherein:

(a) each of said first and second type, shaped connection means include male and female connection members, which complementary mate when a first type and a second type, shaped connection means are joined.

5. A mop holder as defined in claim 3, wherein:

(a) each of said add-on holder sections are end sections having a second type, shaped connection means on one end, and no connection means on the other end for enclosing the lengthwise ends of the basic section.

6. A mop holder as defined in claim 3, wherein:

(a) each of said add-on mop holder sections are extension sections to increase the length of the mop holder and each extension section has a first type, shaped connection means on one end, and a second type, shaped connection means on the other end.

7. A mop holder as defined in claim 6, wherein:

(a) a plurality of said add-on mop holder extension sections are operatively connected in series to each end of the basic mop holder section to provide an increased length mop holder: and, (b) each of the extension sections are retained to adjacent extension sections by a releasable retainer means.

8. A mop holder as defined in claim 7, wherein:

(a) each of the outermost extension sections connected to the ends of the basic mop holder section has an end section connected thereto and retained thereto by a releasable retainer means.

* * * * *